US008684767B2

(12) United States Patent
Emoto et al.

(10) Patent No.: US 8,684,767 B2
(45) Date of Patent: Apr. 1, 2014

(54) TRAIN INFORMATION TRANSMITTING AND RECEIVING SYSTEM

(75) Inventors: Norishige Emoto, Chiyoda-ku (JP); Kazuhiro Iga, Chiyoda-ku (JP); Fumiaki Eura, Chiyoda-ku (JP); Masahiko Ishihara, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 315 days.

(21) Appl. No.: 13/140,204

(22) PCT Filed: Jan. 9, 2009

(86) PCT No.: PCT/JP2009/050240

§ 371 (c)(1),
(2), (4) Date: Jun. 16, 2011

(87) PCT Pub. No.: WO2010/079618

PCT Pub. Date: Jul. 15, 2010

(65) Prior Publication Data

US 2011/0248473 A1 Oct. 13, 2011

(51) Int. Cl.
*H01R 11/00* (2006.01)

(52) U.S. Cl.
USPC ..... 439/502; 439/607.41

(58) Field of Classification Search
USPC ..... 439/502, 607.41, 607.17
See application file for complete search history.

(56) References Cited

U.S. PATENT DOCUMENTS

| | | | | |
|---|---|---|---|---|
| 625,828 | A * | 5/1899 | Case | 439/35 |
| 4,386,814 | A * | 6/1983 | Asick | 439/607.28 |
| 4,571,012 | A * | 2/1986 | Bassler et al. | 439/101 |
| 4,653,825 | A * | 3/1987 | Olsson | 439/295 |
| 5,629,603 | A | 5/1997 | Kinoshita | |
| 5,833,482 | A * | 11/1998 | Buchter | 439/288 |
| 6,395,977 | B1 | 5/2002 | Yamamoto | |
| 6,581,791 | B2 * | 6/2003 | Flint et al. | 213/1.3 |
| 7,753,720 | B2 * | 7/2010 | Emoto et al. | 439/502 |
| 2004/0256142 | A1 | 12/2004 | Masuda et al. | |
| 2009/0042436 | A1 | 2/2009 | Emoto et al. | |

FOREIGN PATENT DOCUMENTS

| | | | |
|---|---|---|---|
| CN | 1244963 | A | 2/2000 |
| CN | 101061018 | A | 10/2007 |
| EP | 1 902 893 | A1 | 3/2008 |
| JP | 06-245327 | A | 9/1994 |

(Continued)

OTHER PUBLICATIONS

International Search Report (PCT/ISA/210) for PCT/JP2009/050240 dated Apr. 7, 2009.

(Continued)

*Primary Examiner* — Neil Abrams
*Assistant Examiner* — Travis Chambers
(74) *Attorney, Agent, or Firm* — Buchanan Ingersoll & Rooney PC

(57) ABSTRACT

First and second vehicle-side connectors that respectively have a ground terminal that is grounded to the vehicles and have a plurality of signal transmission-path terminals, and a vehicle connection cable that is mounted, at both ends, with first and second connectors, and has a plurality of connection-signal transmission paths that connect the connection-signal transmission-path terminals of the first and second connectors, and has a shielding layer that shields the connection-signal transmission paths and is connected to only one of the respective connection ground terminals of the first and second connectors.

2 Claims, 8 Drawing Sheets

(56) References Cited

FOREIGN PATENT DOCUMENTS

| | | | | |
|---|---|---|---|---|
| JP | 2002-051403 | A | 2/2002 | |
| JP | 2005-012925 | A | 1/2005 | |
| JP | 2005-168126 | A | 6/2005 | |
| WO | WO 2007/007495 | A1 | 1/2007 | |
| WO | WO 2007007495 | A1 * | 1/2007 | ..... H02G 3/04 |

OTHER PUBLICATIONS

Written Opinion (PCT/ISA/237) for PCT/JP2009/050240 dated Apr. 7, 2009.

First Office Action dated Mar. 15, 2013, issued in corresponding Chinese Patent Application No. 200980154453.7, and an English Translation of the Office Action. (9 pages).

* cited by examiner

TRAIN INFORMATION TRANSMITTING AND RECEIVING SYSTEM

TECHNICAL FIELD

The present invention relates to a train information transmitting and receiving system that controls various kinds of information and transmits and receives various kinds of information between vehicles within a formed train, so as to monitor, control, and check various electric devices mounted on the train.

BACKGROUND ART

Conventionally, among electrical systems for an automobile that supply electric power to an electrical device from a direct-current power source via a semiconductor power converter, there has been an electrical system for automobiles that uses an electric wire that is formed by having successively concentrically formed from a center, an electric conductive material, a first insulating material, a sheet electrostatic shielding material, a second insulating material, and a sheet magnetic shielding material, for a wiring from the direct-current power source to the semiconductor power converter. In this conventional electrical system, a principal current is conducted to the electric conductive material, one end of the electrostatic shielding material is connected to a ground potential of the semiconductor power converter, and one end of the magnetic shielding material is connected to a casing of the semiconductor power converter (see, for example, Patent Document 1). A shield of this conventional electrical system is grounded at one side.

Patent Document 1: Japanese Patent Application Laid-open No. 2002-051403 (FIG. 1)

DISCLOSURE OF INVENTION

Problem to be Solved by the Invention

Because railway vehicles are mounted with devices such as motors and inverters that generate noise, a transmission path having a noise resistance characteristic needs to be provided to perform a high-speed transmission of information between these vehicles. To secure a noise resistance characteristic, a cable having a shielding layer to shield noise is used in the transmission path.

Generally, a shielding layer has an increased shielding effect when the layer is grounded at two respective ends of a cable. However, in railway vehicles, potentials of a body earth are not constant, and potentials are different when positions and times are different. Therefore, when a shield is grounded to a body at the respective ends of the body, there is a risk that a large amount of current flows to the shield and causes a burnout of the shield. Accordingly, the shield is grounded at only one end. Particularly, when vehicles are of different types, the potential difference becomes large, and thus this requires attention.

According to the technique described in Patent Document 1 mentioned above, the shielding layer is grounded at only one end; however, this is a technique that is supposed to be applied to an automobile, and cannot be applied to a transmission path of information between connected vehicles such as a train.

In railway vehicles, a vehicle connection cable is used to electrically connect adjacent vehicles. A jumper cable having plural kinds of electric wires bundled together is used for the vehicle connection cable. Further, to prepare for a case of occurrence of a vehicle accident or the like, there is also a relief jumper cable that connects signal lines or electric power lines that are minimum necessary, to be able to tow vehicles even when these vehicles are in different formations of different types.

When shielded electric wires are used for these jumper cables, vehicles need to be formed by considering the direction of the jumper cables such that a connection destination of shielding layers becomes at one position and by not changing the directions of the vehicles, and thus this is practically inconvenient. Therefore, in many cases, shielding layers are used without being connected to anywhere (without being grounded) to anywhere, and therefore this has a problem that a shielding effect of the shielding layers cannot be sufficiently exhibited.

The present invention has been achieved in view of the above problems, and an object of the present invention is to obtain a train information transmitting and receiving system that can be used even in an environment of large external noise without constraining formations and operations of vehicles and can transmit information faster than a conventional speed without requiring any new development of a jumper cable for a vehicle connection cable.

Means for Solving Problem

In order to solve the aforementioned problem and attain the aforementioned object, a train information transmitting and receiving system according to one aspect of the present invention is constructed in such a manner as to include: information transmitting and receiving apparatuses that are mounted on each of a plurality of vehicles constituting a train and perform a train information process in coordination with each other; first and second vehicle-side connectors that are set on both ends of each of the vehicles and respectively have a ground terminal that is grounded to each of the vehicles and a plurality of signal transmission-path terminals; first and second in-vehicle wiring cables that have a plurality of signal transmission paths that respectively connect a plurality of respective signal transmission-path terminals of the first and second vehicle-side connectors and the information transmitting and receiving apparatuses, and shielding layers that are grounded to the vehicles and shield the signal transmission paths; and a vehicle connection cable that is mounted, at both ends, with first and second connectors that respectively have connection ground terminals and a plurality of connection-signal transmission-path terminals capable of being respectively engaged with ground terminals and with a plurality of signal transmission-path terminals of the first and second vehicle-side connectors, and has a plurality of connection-signal transmission paths that connect the connection-signal transmission-path terminals of the first and second connectors, and has a single shielding layer that shields a whole of the connection-signal transmission paths by surrounding the whole of the connection-signal transmission paths and is connected to only any one of the respective connection ground terminals of the first and second connectors, wherein a transmission path between adjacent vehicles is constituted by connecting the first vehicle-side connector of one of the adjacent vehicles with the first connector of the vehicle connection cable and connecting the second vehicle-side connector of another one of the adjacent vehicles with the second connector of the vehicle connection cable.

Effect of the Invention

The train information transmitting and receiving system according to the present invention provides such an effect that it can be used even in an environment of large external noise without constraining operations of vehicles and can transmit information faster than a conventional speed without requiring new development of a jumper cable for a vehicle connection cable. Moreover, even if there is a potential difference between adjacent vehicles, an effect is obtained in that the shielding effect is obtained without regard to the direction of connection, by using a jumper cable in which a conventional shielded cable is used without using a special cable and a burnout of a shield does not occur by the current due to the potential difference flowing in the shield.

EXPLANATIONS OF LETTERS OR NUMERALS

Figure 1:
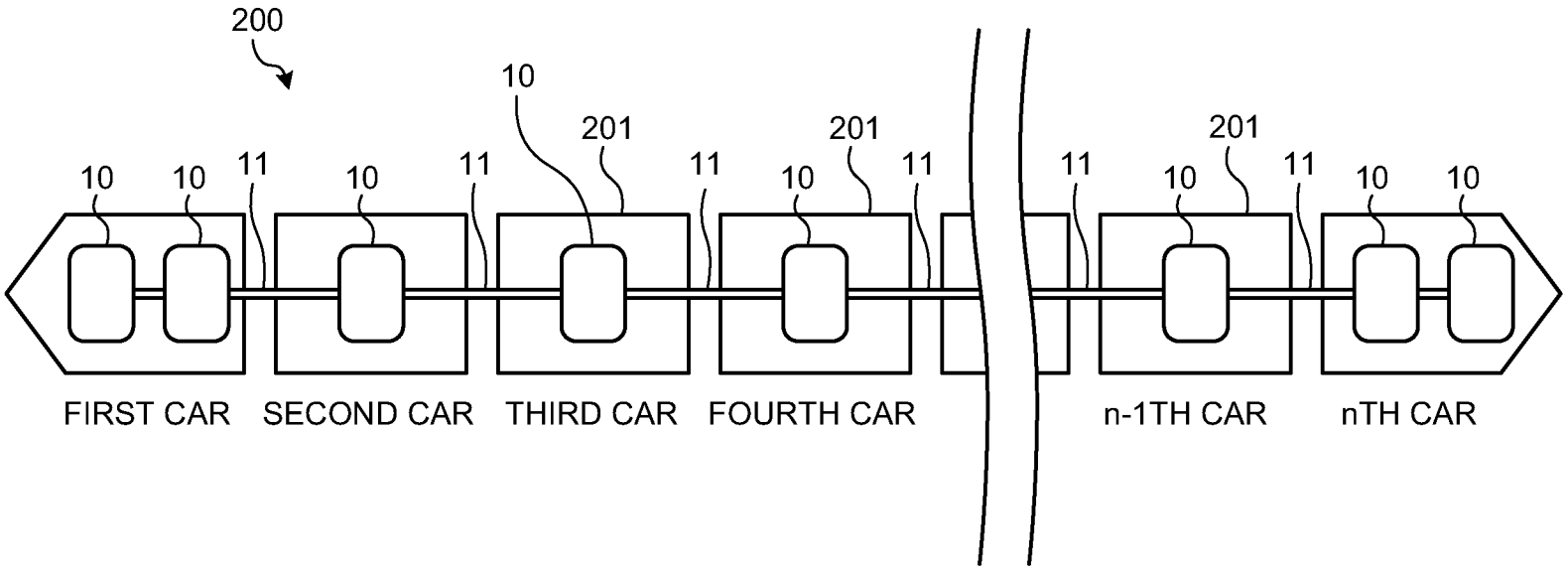
FIG. 1 depicts a configuration of a typical train information transmitting and receiving system.

10 Information transmitting and receiving apparatus
11 Transmission path
21 First in-vehicle wiring cable (including twisted-pair electric wire)
21*a* First vehicle-side connector
21*b* Ground terminal
21*c* Signal transmission-path terminal
22 Second in-vehicle wiring cable (including twisted-pair electric wire)
22*a* Second vehicle-side connector
22*b* Ground terminal
22*c* Signal transmission-path terminal
24, 39, 84 Sheath (protection cover)
25, 35, 85 Electric wire
26, 36, 86 Shielding layer (protection layer)
27, 37, 38, 87 Insulating layer
32 Unshielded electric wire
33 Shielded electric wire
60 Vehicle connection cable
61 First connector
61*b* Connection ground terminal
61*c* Connection-signal transmission-path terminal
62 Second connector
62*b* Connection ground terminal
62*c* Connection-signal transmission-path terminal
80 Shielded twisted-pair electric wire
100 Shielding ground wire
101 Body
200 Train
201 Vehicle
205 Train information transmitting and receiving system

BEST MODE(S) FOR CARRYING OUT THE INVENTION

Exemplary embodiments of a train information transmitting and receiving system according to the present invention will be explained below in detail with reference to the accompanying drawings. The present invention is not limited to the embodiments.

Embodiment

Figure 2:
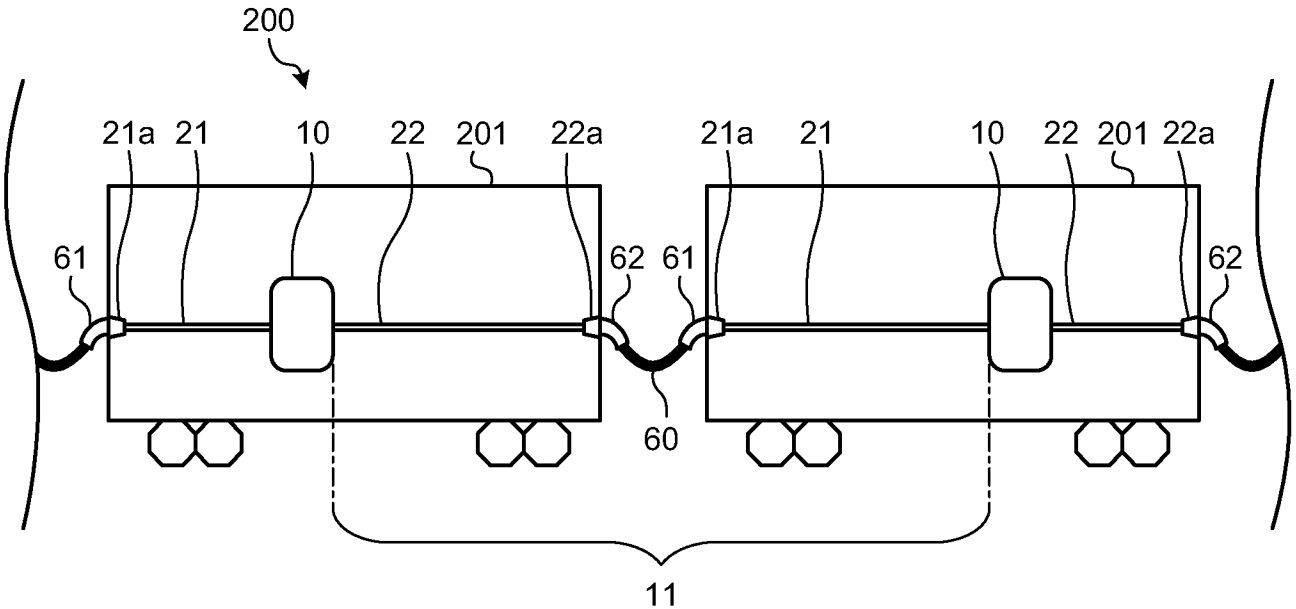
FIG. 2 depicts a configuration of a transmission path of a train information transmitting and receiving system.

FIG. 1 depicts a schematic configuration of a typical train information transmitting and receiving system, and FIG. 2 depicts a configuration of a transmission path of a train information transmitting and receiving system.

As shown in FIG. 1, an information transmitting and receiving apparatus 10 is mounted on each vehicle 201 of a train 200, and information transmitting and receiving apparatuses 10 that are mounted on adjacent vehicles 201 and 201 are connected to each other by a transmission path 11.

As shown in FIG. 2, each transmission path 11 connects a first in-vehicle wiring cable 21, a first vehicle-side connector 21*a*, a first connector 61, a vehicle connection cable 60, a second connector 62, a second vehicle-side connector 22*a*, and a second in-vehicle wiring cable 22.

Each of the information transmitting and receiving apparatuses 10 is connected to another information transmitting and receiving apparatus 10 mounted on an adjacently connected vehicle, via the first in-vehicle wiring cable 21, the first vehicle-side connector 21*a*, the first connector 61, the vehicle connection cable 60, the second connector 62, the second vehicle-side connector 22*a*, and the second in-vehicle wiring cable 22.

The first vehicle-side connector 21*a* is set at a front end of each vehicle, and the second vehicle-side connector 22*a* is set at a back end of the vehicle. The first and second connectors 61 and 62 are mounted on the vehicle connection cable 60. Either the first connector 61 or second connector 62 is engaged with the first vehicle-side connector 21*a*, and the other is engaged with the second vehicle-side connector 22*a*, thereby connecting the first in-vehicle wiring cable 21, the vehicle connection cable 60, and the second in-vehicle wiring cable 22.

Figure 3:
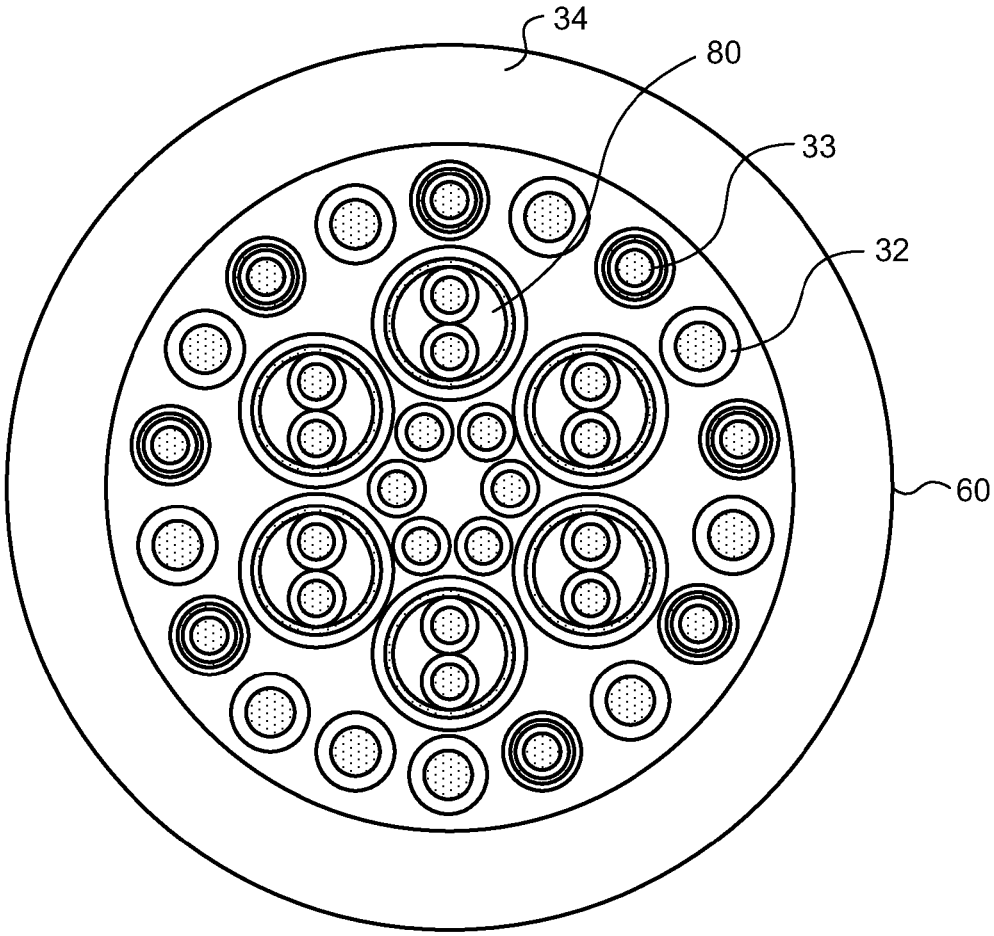
FIG. 3 is a cross-sectional view of a vehicle connection cable according to an embodiment of the present invention.

FIG. 3 is a cross-sectional view of the vehicle connection cable 60 according to an embodiment of the present invention. A jumper cable having plural kinds of cables bundled together is used for the vehicle connection cable 60. The vehicle connection cable 60 is a bundle of plural shielded twisted-pair electric wires 80, plural shielded electric wires 33, and plural unshielded electric wires 32 that are bundled together, the bundle being covered with a sheath (a protection cover) 34.

Numbers of electric wires for a vehicle connection cable and layouts and wire diameters of the electric wires are varied. A vehicle connection cable according to the present invention is not limited to the vehicle connection cable 60 according to the present embodiment.

Figure 4:
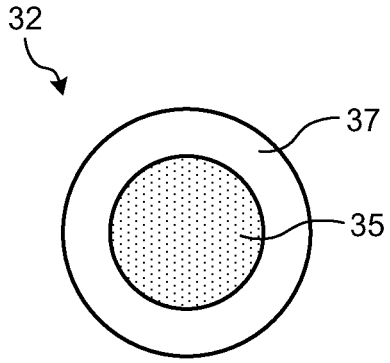
FIG. 4 is a cross-sectional view of an unshielded electric wire.

FIG. 4 is a cross-sectional view of an unshielded electric wire. The unshielded electric wire 32 is provided by covering an electric wire 35 with a cylindrical insulating layer 37.

Figure 5:
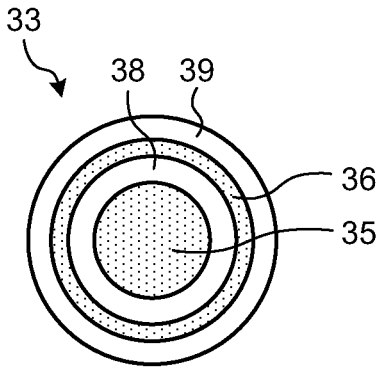
FIG. 5 is a cross-sectional view of a shielded electric wire.

FIG. 5 is a cross-sectional view of a shielded electric wire. The shielded electric wire 33 is structured by covering the electric wire 35 with a cylindrical insulating layer 38, covering the insulating layer 38 with a shielding layer 36 formed by a copper wire or the like in a cylindrical shape, and further covering the shielding layer 36 with a cylindrical insulating layer 39.

Figure 6:
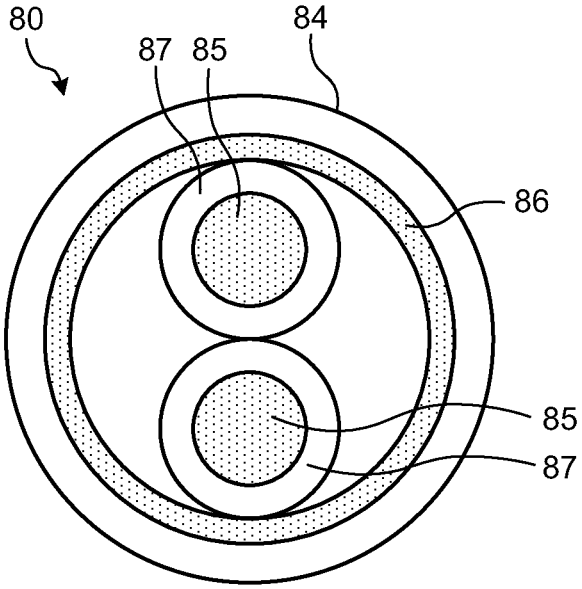
FIG. 6 is a cross-sectional view of a shielded twisted-pair electric wire.

FIG. 6 is a cross-sectional view of a shielded twisted-pair electric wire. The twisted-pair electric wire 80 is structured by twisting two insulating electric wires together that are electric wires 85 and 85 as connection-signal transmission paths covered with cylindrical insulating layers 87 and 87, covering a periphery of the twisted two insulating electric wires with a shielding layer 86, and covering a periphery of the shielding layer 86 with a sheath (a protection cover) 84.

The jumper cable used for the vehicle connection cable 60 that directly connects vehicles is required to have high mechanical strength. Therefore, a hard drawn copper wire is used at a center of each of the electric wires 35 and 85 within the jumper cable. An annealed copper wire is twisted together around the hard drawn copper wire, thereby forming the electric wires 35 and 85.

Figure 7:
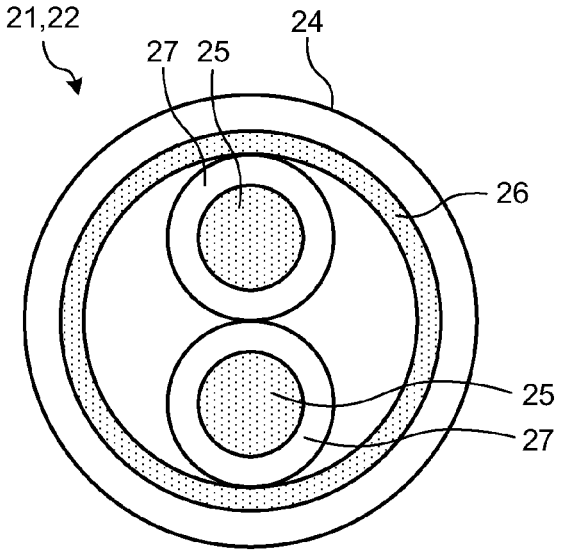
FIG. 7 is a cross-sectional view of a shielded twisted-pair electric wire.

FIG. 7 depicts a cross section of a shielded twisted-pair electric wire used for the first and second in-vehicle wiring cables 21 and 22. This twisted-pair electric wire is structured by twisting together two insulating electric wires that are formed by covering peripheries of electric wires 25 and 25 with cylindrical insulating layers 27 and 27, covering a periphery of the cylindrical insulating layers 27 and 27 with a shielding layer 26, and covering the shielding layer 26 with a sheath (a protection cover) 24.

Generally, shielded cables are tolerant against external noise. Meanwhile, a train is mounted with various electrical devices that handle a high voltage or a high frequency, and noise is always generated. Therefore, the first and second in-vehicle wiring cables 21 and 22 shown in FIG. 7 are used for a transmission path within a vehicle. Further, at a portion where vehicles are connected together, the shielded twisted-pair electric wire 80 is selectively used for a transmission path from among electric wires that constitute the vehicle connection cable 60.

FIGS. 8 to 12 are schematic diagrams of a general train information transmitting and receiving system.

Figure 8:
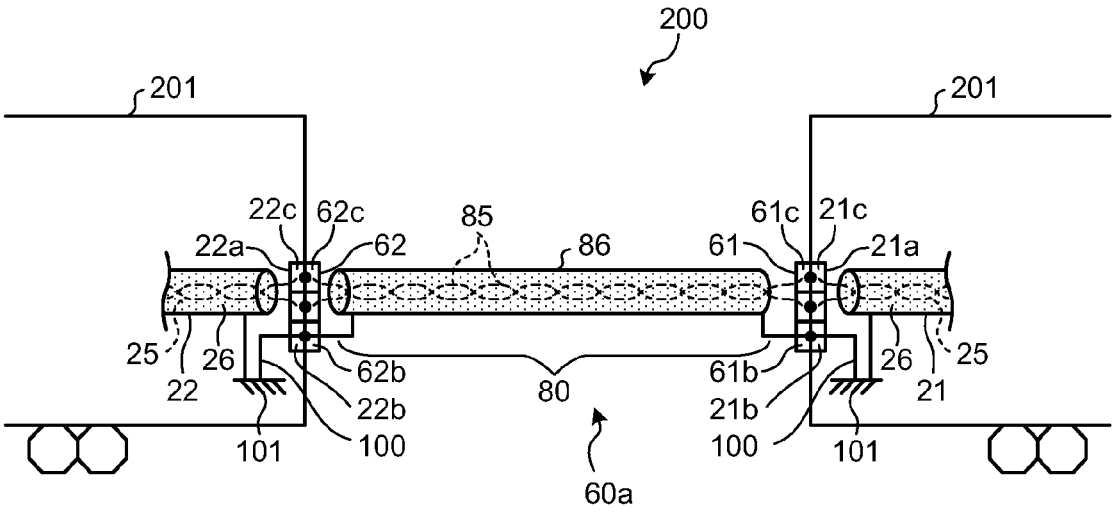
FIG. 8 depicts a general train information transmitting and receiving system.

In the train information transmitting and receiving system shown in FIG. 8, the first and second vehicle-side connectors 21*a* and 22*a* have respective ground terminals 21*b* and 22*b* grounded to bodies 101 and 101 of the vehicles 201 and 201 via shielding ground wires 100 and 100, and have two (plural) signal transmission-path terminals 21*c* and 22*c*, respectively.

The first and second in-vehicle wiring cables 21 and 22 have plural signal transmission paths (electric wires) 25 and 25 that respectively connect the respective two (plural) signal transmission-path terminals 21*c* and 22*c* of the first and second vehicle-side connectors 21*a* and 22*a* and the information transmitting and receiving apparatuses 10, and have shielding layers 26 and 26 that are grounded to the bodies 101 and 101 of the vehicles 201 and 201 and shield the plural signal transmission paths 25 and 25.

A vehicle connection cable 60*a* is mounted, at both ends, with the first and second connectors 61 and 62 that have connection ground terminals 61*b* and 62*b* and plural connection-signal transmission-path terminals 61*c* and 62*c* that can be respectively engaged with the ground terminals 21*b* and 22*b* and the plural signal transmission-path terminals 21*c* and 22*c* of the first and second vehicle-side connectors 21*a* and 22*a*, and includes the twisted-pair electric wire 80 that has plural connection-signal transmission paths 85 and 85 that connect the plural connection-signal transmission-path terminals 61*c* and 62*c* of the first and second connectors 61 and 62, and a shielding layer 86 that shields the plural connection-signal transmission paths 85 and 85 and is connected to both the first and second connectors 61 and 62.

That is, in the train information transmitting and receiving system shown in FIG. 8, at two positions of both ends of the shielded twisted-pair electric wire 80 of the vehicle connection cable 60*a*, the shielding layer 86 is grounded to the bodies 101 and 101 via the connection ground terminals 61*b* and 62*b* of the first and second connectors 61 and 62, the ground terminals 21*b* and 22*b* of the first and second vehicle-side connectors 21*a* and 22*a*, and the shielding ground wires 100 and 100.

In the train information transmitting and receiving system shown in FIG. 8, in railway vehicles in which potentials of bodies are not constant depending on positions, there is a risk that a large amount of current flows to the shielding layer 86 and causes a burnout of the shielding layer 86.

Figure 9:
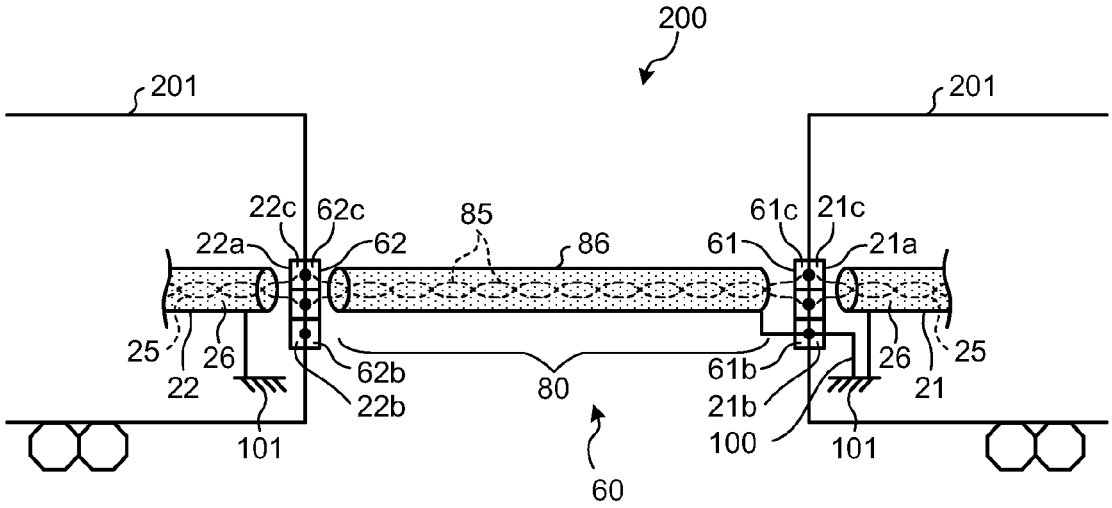
FIG. 9 depicts a general train information transmitting and receiving system.

In the train information transmitting and receiving system shown in FIG. 9, at only one position of one side of the shielded twisted-pair electric wire 80 of the vehicle connection cable 60, the shielding layer 86 is grounded to the body 101 via the connection ground terminal 61*b* of the first connector 61, the ground terminal 21*b* of the first vehicle-side connector 21*a*, and the shielding ground wire 100.

Figure 10:
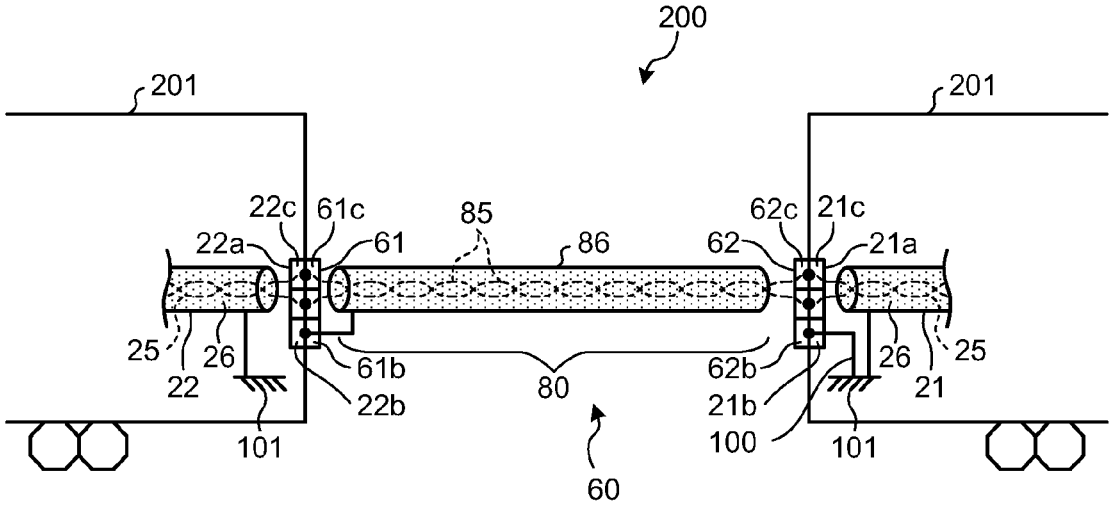
FIG. 10 depicts a general train information transmitting and receiving system.
Figure 11:
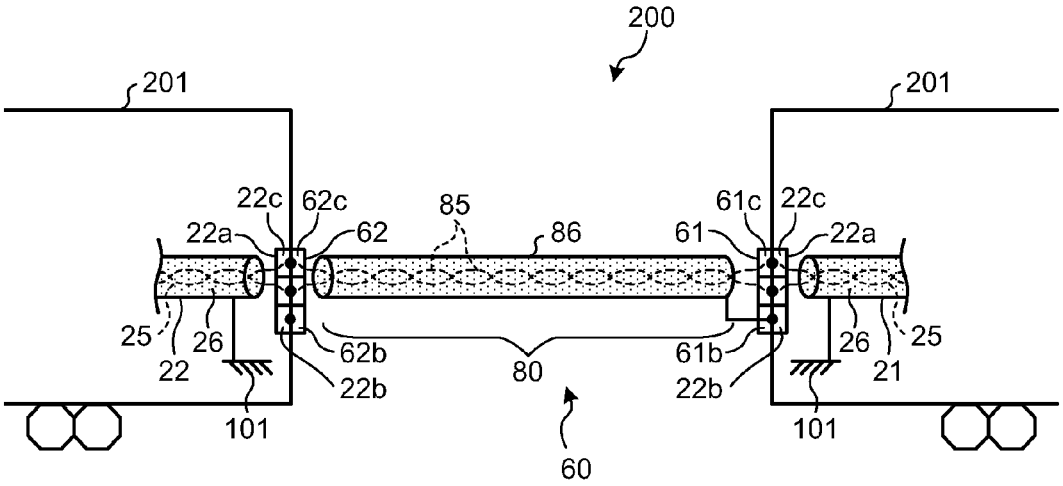
FIG. 11 depicts a general train information transmitting and receiving system.

FIG. 10 depicts a state that the vehicle connection cable 60 is connected to a direction opposite to that in a connection state shown in FIG. 9. In this state, the shielding layer 86 is not grounded to the body 101 at any side.

In the connection state shown in FIG. 10, an effect of shielding external noise is small because the shielding layer 86 of the vehicle connection cable 60 is not grounded. In the train information transmitting and receiving system shown in FIG. 9, when the direction of the vehicle 201 is changed, the connection becomes in a connection state shown in FIG. 11. In the connection state shown in FIG. 11, an effect of shielding external noise is also small in a similar manner to that in the connection state shown in FIG. 10.

To obtain a sufficient external-noise shielding effect by securing the ground state shown in FIG. 9, the vehicles 201 need to be connected together, considering not only the direction of the vehicle connection cable 60 but the directions of the vehicles 201 as well.

Figure 12:
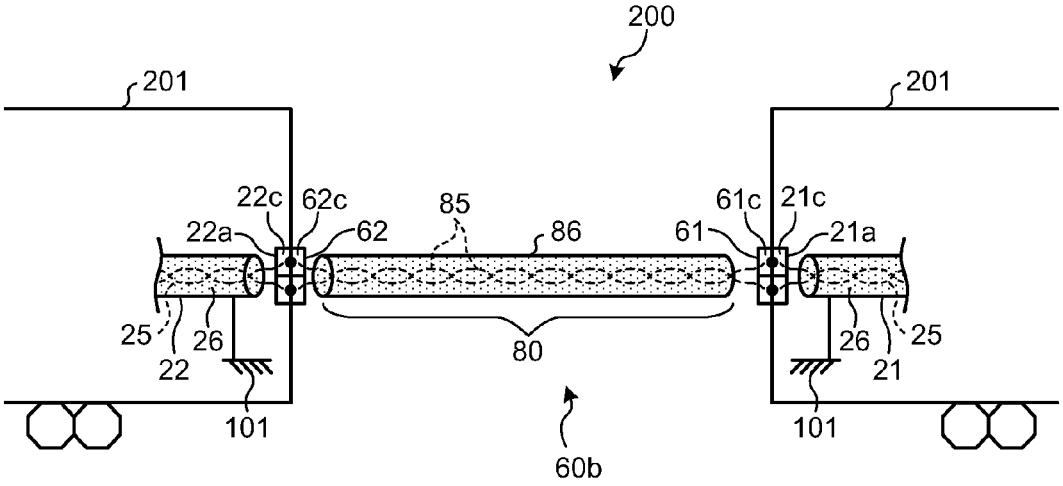
FIG. 12 depicts a general train information transmitting and receiving system.

In the train information transmitting and receiving system shown in FIG. 12, the shielding layer 86 of the shielded twisted-pair electric wire 80 of a vehicle connection cable 60*b* is not grounded to the body. The same connection state is obtained even when the direction of the vehicle connection cable 60*b* and the direction of the vehicle 201 are changed. Therefore, in a connection operation of the train 200, it is not necessary to consider the direction of the vehicle connection cable 60*b* and the direction of the vehicle 201. However, this connection state is similar to the connection states shown in FIGS. 10 and 11 in that a sufficient external-noise shielding effect cannot be obtained.

Figure 13:
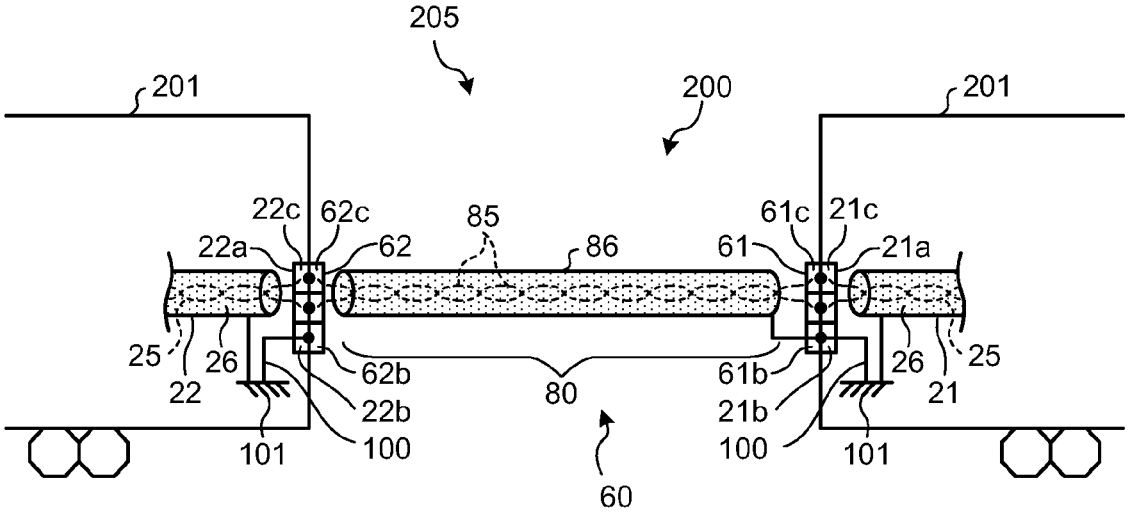
FIG. 13 depicts a train information transmitting and receiving system according to the embodiment of the present invention.
Figure 14:
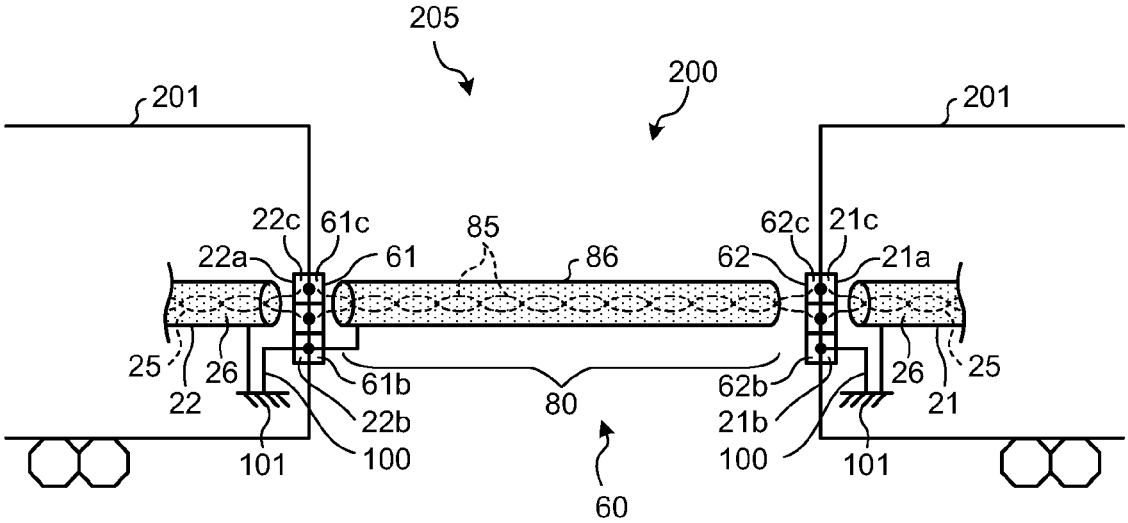
FIG. 14 depicts the train information transmitting and receiving system according to the embodiment of the present invention.

FIGS. 13 and 14 depict a train information transmitting and receiving system 205 according to the embodiment of the present invention. As shown in FIG. 13, the first and second vehicle-side connectors 21*a* and 22*a* that are respectively set at both ends of the respective vehicles 201 and 201 have the respective ground terminals 21*b* and 22*b* grounded to the bodies 101 and 101 of the vehicles 201 and 201 via the shielding ground wires 100 and 100, and have the respective two (plural) signal transmission-path terminals 21*c* and 22*c*.

The first and second in-vehicle wiring cables 21 and 22 have the plural signal transmission paths 25 and 25 that respectively connect the respective two (plural) signal transmission-path terminals 21*c* and 22*c* of the first and second vehicle-side connectors 21*a* and 22*a* and the information transmitting and receiving apparatuses 10, and have the shielding layers 26 and 26 that are grounded to the bodies 101 and 101 of the vehicles 201 and 201 and shield the plural signal transmission paths 25 and 25.

The vehicle connection cable 60 is mounted, at both ends, with the first and second connectors 61 and 62 respectively that have the connection ground terminals 61*b* and 62*b* and the plural connection-signal transmission-path terminals 61*c* and 62*c* that can be respectively engaged with the ground terminals 21*b* and 22*b* and the plural signal transmission-path terminals 21*c* and 22*c* of the first and second vehicle-side connectors 21*a* and 22*a*, and includes the twisted-pair electric wire 80 that has the plural connection-signal transmission paths 85 and 85 that connect the plural connection-signal transmission-path terminals 61*c* and 62*c* of the first and second connectors 61 and 62, and the shielding layer 86 that shields the plural connection-signal transmission paths 85 and 85 and is connected to only one of connection ground terminals 61*b* and 62*b* of the respective first and second connectors 61 and 62.

That is, in the train information transmitting and receiving system 205 according to the present embodiment shown in FIG. 13, the shielding layer 86 of the twisted-pair electric wire 80 is connected to the connection ground terminal 61*b* of the one (first) connector 61 and is not connected to the connection ground terminal 62*b* of the other (second) connector 62, of the vehicle connection cable 60.

On the other hand, at the side of the vehicles 201 and 201, the shielding ground wires 100 and 100 that are grounded to the bodies 101 and 101 are connected to the ground terminals 21*b* and 22*b* of the vehicle-side connectors 21*a* and 22*a*, respectively. In this state, when the first and second connectors 61 and 62 of the vehicle connection cable 60 are respectively connected to the first and second vehicle-side connectors 21*a* and 22*a*, the shielding layer 86 is connected to only the body 101 at one side.

FIG. 14 depicts a state that the vehicle connection cable 60 is connected to a direction opposite to that in the connection state shown in FIG. 13. Even in this state, the shielding layer 86 is connected to only the body 101 at one side. In this manner, the shielding layer 86 of the vehicle connection cable 60 can be connected to only the body 101 of one side, even when the directions of the vehicle connection cable 60 and the vehicles 201 and 201 are not considered.

As for a connection-signal transmission path of the vehicle connection cable 60, plural shielded electric wires 33 can be also used instead of the twisted-pair electric wire 80.

According to the train information transmitting and receiving system 205 of the present embodiment, even when the information transmitting and receiving apparatuses 10 and 10 mounted on separate vehicles 201 and 201 transmit information to each other via the vehicle connection cable 60, information can be transmitted faster than a conventional speed by securing a sufficient effect of shielding external noise without considering the direction of the vehicle connection cable 60 and the directions of the vehicles 201 and 201.

Industrial Applicability

As described above, the train information transmitting and receiving system according to the present invention is useful as a train information transmitting and receiving system for a train of which vehicle formations are changed.

The invention claimed is:

1. A train information transmitting and receiving system comprising:

information transmitting and receiving apparatuses that are mounted on a plurality of vehicles constituting a train, respectively, and perform a train information process in coordination with each other;

first and second vehicle-side connectors that are respectively set on both ends of each of the vehicles and respectively have a ground terminal that is grounded to each of the vehicles and a plurality of signal transmission-path terminals;

first and second in-vehicle wiring cables that have a plurality of signal transmission paths that respectively connect the plurality of respective signal transmission-path terminals of the first and second vehicle-side connectors and the information transmitting and receiving apparatuses, and shielding layers that are grounded to the vehicles and shield the signal transmission paths; and a vehicle connection cable that is mounted, at both ends, with first and second connectors that respectively have connection ground terminals and a plurality of connection-signal transmission-path terminals configured to be respectively engaged with ground terminals and with a plurality of signal transmission-path terminals of the first and second vehicle-side connectors, and has a plurality of connection-signal transmission paths that connect the connection-signal transmission-path terminals of the first and second connectors, and has a single shielding layer that shields a whole of the connection-signal transmission paths by surrounding the whole of the connection-signal transmission paths and is connected to only any one of the respective connection ground terminals of the first and second connectors, wherein a transmission path between adjacent vehicles is constituted by connecting the first vehicle-side connector of one of the adjacent vehicles with the first connector of the vehicle connection cable and connecting the second vehicle-side connector of another one of the adjacent vehicles with the second connector of the vehicle connection cable.

2. The train information transmitting and receiving system according to claim 1, wherein the first and second in-vehicle wiring cables and the vehicle connection cable have a twisted-pair electric wire as a signal transmission path.

* * * * *